US005870074A

United States Patent [19]

Iwasaki

[11] Patent Number: 5,870,074

[45] Date of Patent: Feb. 9, 1999

[54] IMAGE DISPLAY CONTROL DEVICE, METHOD AND COMPUTER PROGRAM PRODUCT

[75] Inventor: Keiichi Iwasaki, Yokohama, Japan

[73] Assignee: Ricoh Company, Ltd., Tokyo, Japan

[21] Appl. No.: 747,886

[22] Filed: Nov. 13, 1996

[30] Foreign Application Priority Data

Nov. 13, 1995 [JP] Japan ..... 7-294074

[51] Int. Cl.[6] ..... G09G 5/22; G09G 5/26

[52] U.S. Cl. ..... 345/141; 345/128

[58] Field of Search ..... 345/141, 112, 345/116, 192, 123, 121, 128, 113, 114, 127; 348/569

[56] References Cited

U.S. PATENT DOCUMENTS 5,608,424 3/1997 Takahashi et al. ..... 345/141
5,623,316 4/1997 Naito et al. ..... 348/569

FOREIGN PATENT DOCUMENTS 27478 2/1990 Japan ..... G09G 5/36
244078 10/1990 Japan ..... G09G 5/36
443595 7/1992 Japan ..... G09G 5/36

*Primary Examiner*—Steven J. Saras
*Assistant Examiner*—David L. Lewis
*Attorney, Agent, or Firm*—Cooper & Dunham LLP

[57] ABSTRACT

A character table unit stores as attribute data of each character of an image a character name, a horizontal direction character size, a vertical direction character size, a horizontal display coordinate value and, a vertical display coordinate. A counter outputs count values indicating a horizontal position and a vertical position in a display screen image. A first writing control unit reads from the character table unit the attribute data of an appropriate character based on the count values of the counter and the attribute data, produces basic size attribute data of basic size characters which constitute at least part of the character. The basic size character is determined to be currently displayed based on the count values. The basic size character attribute data is written in a hit buffer. A image data memory stores character image data. A second writing control unit reads basic size attribute data from the hit buffer, producing addresses based on the basic size attribute data to read character image data from the image data memory, and writing the character image data into a line buffer. Image data is read from the line buffer, in synchronization with the count value indicating a current horizontal position.

16 Claims, 13 Drawing Sheets

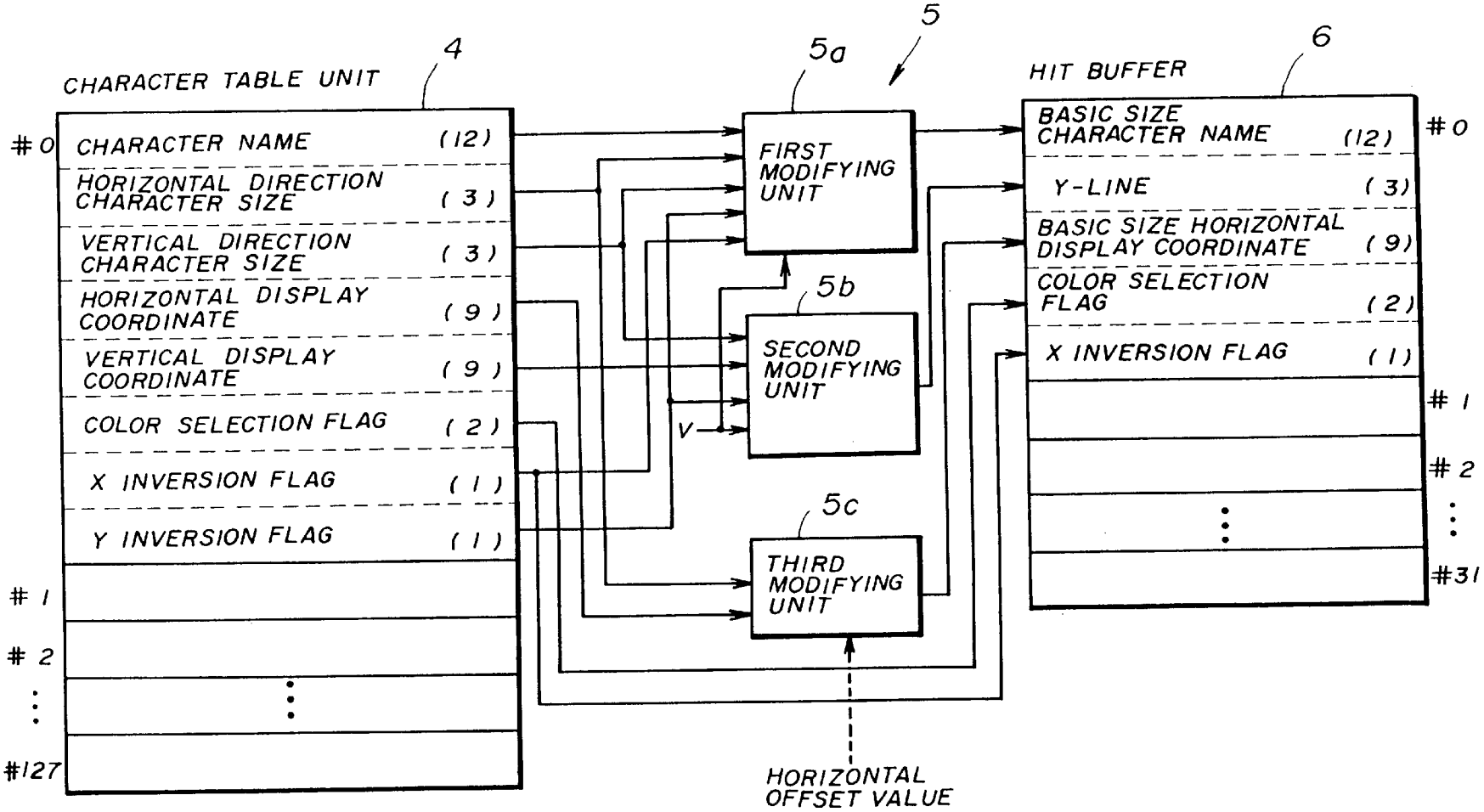
FIG. 3
HIT BUFFER
6
#0
#1
#2
#31
BASIC SIZE CHARACTER NAME (12)
Y-LINE (3)
BASIC SIZE HORIZONTAL DISPLAY COORDINATE (9)
COLOR SELECTION FLAG (2)
X INVERSION FLAG (1)
5
5a
FIRST MODIFYING UNIT
5b
SECOND MODIFYING UNIT
5c
THIRD MODIFYING UNIT
V
HORIZONTAL OFFSET VALUE
4
CHARACTER TABLE UNIT
#0
#1
#2
#127
CHARACTER NAME (12)
HORIZONTAL DIRECTION CHARACTER SIZE (3)
VERTICAL DIRECTION CHARACTER SIZE (3)
HORIZONTAL DISPLAY COORDINATE (9)
VERTICAL DISPLAY COORDINATE (9)
COLOR SELECTION FLAG (2)
X INVERSION FLAG (1)
Y INVERSION FLAG (1)

IMAGE DISPLAY CONTROL DEVICE, METHOD AND COMPUTER PROGRAM PRODUCT

BACKGROUND OF THE INVENTION

1. Field of the Invention

The present invention relates to an image display for displaying an image (in particular, characters, figures, symbols, or the like) on a scanning-type display of a personal computer, a video game machine or the like.

2. Description of the Related Art

Japanese Patent Publication No.2-7478 discloses a TV game machine. In the machine, in order to display a plurality of moving-picture characters, a number of shift registers are provided, the number of shift registers being the same as the number of moving-picture characters which can be displayed in one scanning period. Data is shifted according to respective moving-picture character display timing. Japanese Patent Publication No.2-44078 discloses a scanning-type display control method. In the method, two sets of buffers, each set including a row buffer and a column buffer, are provided. A CPU writes attribute information of a moving sample into attribute-information storing means, the moving sample being displayed on a CRT display. Other than the writing duration, the CPU can perform other processing such as game control processing.

In the above-mentioned prior art, generally, a character having a fixed size can be handled. In order to achieve display of a character having a larger size, the larger character consists of a plurality of fixed-size divisions. However, in such a method, in order to move the larger character, it is necessary to perform attribute information alteration for each fixed-size division. Thereby, the software scale should be increased and the CPU working efficiency may be degraded.

In order to solve such a problem, Japanese Patent Publication No.4-43595 discloses a moving-picture display device. In the device, when video data is written in an editing memory which stores information to be displayed in one scanning line as scanning-line video data, the writing is controlled with horizontal display size information. Thereby, a plurality of moving-picture figures having different display sizes are displayed in a mixed manner.

However, in this device, video data writing is controlled based on horizontal display size information as mentioned above. Thereby, it may not be possible to efficiently access a memory which has previously stored video data.

SUMMARY OF THE INVENTION

An object of the present invention is to provide an image display control in which, through a simple circuit configuration, efficient memory access can be achieved, characters having different sizes can be displayed in a mixed manner, and various display effects can be provided.

An image display control device, according to the present invention, comprises:

a first storage device for storing, as attribute data of each character, at least a character name, a horizontal direction character size, a vertical direction character size, a horizontal display coordinate value, and a vertical display coordinate;

a counter for outputting count values indicating a horizontal position and a vertical position in a display screen image;

a first writing control means for reading from the first storage device the attribute data of an appropriate character based on the count values of the counter and the attribute data, producing basic size attribute data of basic size characters which constitute at least part of the character, the basic size character being determined to be currently displayed based on the count values, and writing the basic size character attribute data in a second storage device;

a third storage device for storing character image data;

a second writing control means for reading basic size attribute data from the second storage device, producing addresses based on the basic size attribute data to read character image data from the third storage device, and writing the character image data into a fourth storage device; and means for reading image data, stored in the fourth storage device, in synchronization with the count value indicating a current horizontal position.

When an original character stored in the first storage device has a size several times the basic size, the first writing control means, based on an attribute of the character, produces basic size attribute data of basic size characters which consists of the above-mentioned original character, and writes the basic size attribute data in the second storage device. The second writing control means, in accordance with the basic size attribute data stored in the second storage device, reads image data from the third storage device, and writes it in the fourth storage device.

It is possible to display various sizes of characters in a mixed manner. Further, the second writing control means should read image data from the third storage device and write it in the fourth storage device in a manner in which a basic size character is processed. In comparison to the related art in which image data is processed based on horizontal display size information, accessing to the third storage device can be efficiently performed, and the number of characters which can be displayed can be increased. Thus, without complicated hardware configuration, it is easy to form an LSI circuit of the arrangement.

Another aspect of the present invention is that the horizontal size of the character is set to be a natural number-times multiple of the horizontal size of a basic size character in the horizontal direction character size;

the vertical size of the character is set to be a natural number multiple of the vertical size of a basic size character in the vertical direction character size; and the basic size character has a size of a predetermined number of dots in the horizontal direction by a predetermined number of dots in the vertical direction.

It may be that bits of the horizontal display coordinate and the vertical display coordinate is set such that the bits may include bits which are located outside of the horizontal and vertical direction coordinate range of the display screen image. It is possible to provide an imaginary screen image which is larger than a display screen image. An operation of a character such that the character appears on and disappears from the display screen image vertically or horizontally can be smoothly performed. Further, if a specific character stored in the first storage device should be removed from the display screen image, the character is made to have a display coordinate value which represents a position outside of the display screen image in the imaginary screen image.

A further aspect of the present invention is that the first writing control means reads attribute data of each character from the first storage device and writes in the second storage device the basic size attribute data of basic size characters during a display period in a horizontal scanning period, the basic size characters constituting a part of a character determined to be displayed in the subsequent horizontal scanning period;

the second writing control means successively reads basic size attribute data from the second storage device in a horizontal retrace period, reads image data by providing addresses based on the basic size attribute data to the third storage device, and writes the image data in the fourth storage device.

Thus, the horizontal retrace period is effectively used. Thereby, in a raster-type display device, smooth image displaying can be performed.

An aspect of the present invention provides determining means for determining whether a character read from the first storage device is a relevant character, based on a count value of the counter indicating a current vertical position, and the vertical display coordinate and the vertical direction character size of the attribute data, the determining means providing a determination result;

writing control signal generating means for providing one or a plurality of writing control signals to the second storage device based on the determination result and the horizontal direction character size in the attribute data;

a first modifying unit for generating first writing data based on a count value indicating a current vertical position, and the vertical display coordinate, character name, horizontal direction character size and vertical direction character size of the attribute data;

a second modifying unit for generating second writing data based on a count value indicating a current vertical position, the vertical direction character size and vertical display coordinate of the attribute data; and a third modifying unit for generating third writing data based on the horizontal direction character size and horizontal display coordinate of the attribute data.

An aspect of the second storage device comprises a memory unit for storing basic size attribute data; and an address generating circuit for generating addresses in one of an increasing order and a decreasing order when the first writing control means writes data in the memory unit, and generating addresses in the other of the increasing order and decreasing order when the second writing control means reads data from the memory unit.

When the number of basic size characters which constitutes a portion which has been determined to be displayed exceeds a predetermined number, the attribute data of the exceeding number of basic size characters is not stored in the second storage device. Thereby, a defective character may be create. When the display coordinates of the attribute data of respective characters overlap or are near each other, these characters are displayed in an overlapping manner as a result of the image data being overwritten on the fourth storage device. If the image data of such a defective character were read from the second storage device at the last, the defective character might cover a non-defective character, the image data of which were previously read, when displayed on the scanning-type display. However, in this arrangement of the present invention, an order in which attribute data is read in the hit buffer 6 is reverse to an order in which the attribute data was written. Therefore, such a problem should not occur. That is, a defective character, if any, should not cover another non-defective character when displayed on the scanning-type display.

Another aspect of the present invention is that the second storage device is provided with a first flag which is set when the address generating circuit generates a first predetermined address and a second flag which is set when the address generating circuit generates a second predetermined address;

the first writing control means is provided with a writing request generating means for preventing data from being written in the second storage device when the first flag is set and otherwise requesting data writing; and the second writing control means is provided with a reading request generating means for preventing data from being read from the second storage device when the second flag is set and otherwise requesting data reading.

It may be that the first writing control means is provided with a third flag which is set when data is attempted to be written in the storage means in the condition where the first flag is set. Especially, if the contents of attribute data stored in the first storage device can be altered by instructions given by a central processing unit, and the central processing unit recognizes the set state of the third flag as an interrupt signal, for example, when the third flag is in the set state, the order of characters stored in the first storage device can be altered, and a display priority order can be altered.

A further aspect of the present invention includes a display selection flag being set as one of the attribute data stored in the first storage device;

a plurality of the fourth storage devices are provided; and the second writing control means selectively writes data in one of the plurality of the fourth storage devices based on the display selection flag.

By appropriately determining display priority of image data of the plurality of fourth storage devices, a display can be easily performed, for example, an "airplane" flies from the left to the right, in front of "mountains", and the "airplane" flies from the right to the left, behind the "mountains".

It may be that the image display control device further comprises a boundary register for storing an address value indicating a boundary for dividing the first storage device into two portions; and wherein the second writing control means writes data in one of at least two the fourth storage device, selectively based on the address value.

By appropriately determining display priority of image data of at least two the fourth storage devices, even if the "sun" character and an "airplane" character are located at the same position, a state in which the "sun character" covers the "airplane" character is avoided.

Another aspect of the present invention is that a color selection flag is set as one of attribute data stored in the first storage device; and the second writing control means adds data, specified by the color selection flag, to image data and, then, writes resulting image data in the fourth storage device.

A further aspect of the present invention includes an inversion flag is set as one of attribute data stored in the first storage device; and the first writing control means produces basic size attribute data depending on the inversion flag; and the second writing control means produces image data to be provided to the fourth storage device depending on the inversion flag. Thereby, image inversion processing can be easily performed.

It may be that the image display control device further comprises an offset register for indicating an offset position in a screen image, the first writing control means produces basic size attribute data depending on the offset resister value. Thereby, processing such as image scrolling can be easily performed and a superior display effect can be provided.

Other objects and further features of the present invention will become more apparent from the following detailed description when read in conjunction with the accompanying drawings.

BRIEF DESCRIPTION OF THE DRAWINGS

FIG. 3 shows a concept of a specific relationship between a character table unit, a first writing control circuit and a hit buffer in the embodiment of the present invention;

FIG. 9C illustrates basic size character rectangles and Y-line in the basic size attribute data;

DETAILED DESCRIPTION OF A PREFERRED EMBODIMENT

Figure 1:
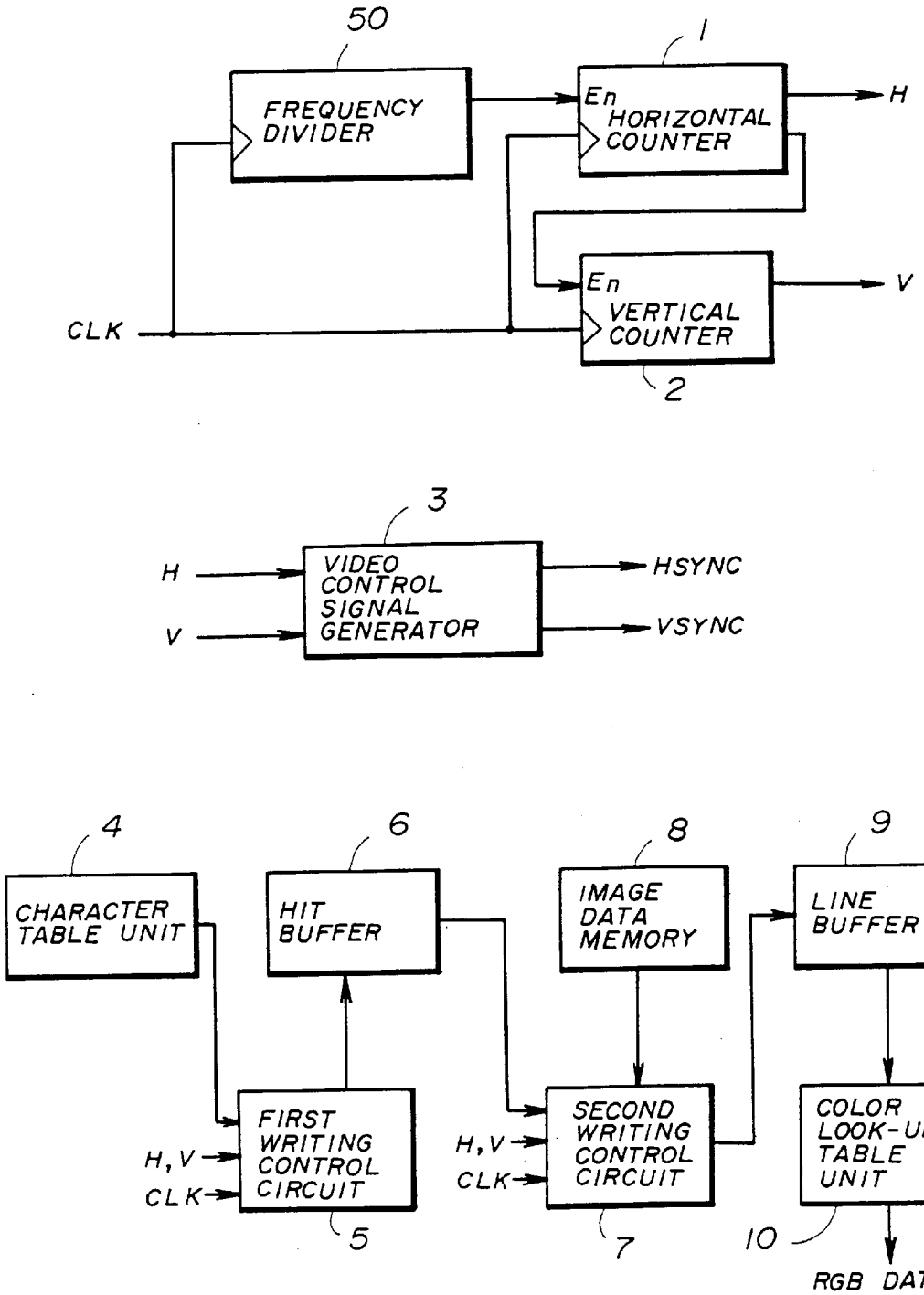
FIG. 1 shows a block diagram of an image display control device in an embodiment of the present invention.

FIG. 1 shows a block diagram of a general configuration of an image display control device in an embodiment of the present invention.

A horizontal direction counter 1 counts dot clock pulses (CLK), each indicating a one dot display period, in response to a signal from a frequency divider 50. A count value H of the horizontal direction counter 1 is data which corresponds to dot display positions in the horizontal direction for one horizontal period including a horizontal retrace period. The horizontal direction counter 1 outputs a vertical count enable signal each time the count value goes around, that is, when the above-mentioned one horizontal period elapses.

A vertical direction counter 2 counts the dot clock pulses for each time of receiving the vertical count enable signal from the horizontal direction counter 1. A count value V of the vertical direction counter 2 represents data which indicates a dot display position in the vertical direction in one screen image display period (vertical period) including a vertical retrace period.

A video control signal generator 3 receives the horizontal count value H and vertical count value V, and provides a horizontal synchronization signal (HSYNC) and a vertical synchronization signal (VSYNC).

A character table unit 4 (first storage device) 4 stores attribute data of a number of characters, this number is the maximum number of characters which can be displayed on one frame of a scanning-type display. In this embodiment, as shown in FIG. 3, attribute data of a total of 128 characters, #0 to #127 is stored in the character table unit 4. For each character, the attribute data includes a character name (12 bits), a horizontal direction character size (3 bits), a vertical direction character size (3 bits), a horizontal display coordinate (9 bits), a vertical display coordinate (9 bits), a color selection flag (2 bits), an X inversion flag (1 bit) and a Y inversion flag (1 bit). Each character name represents the address for reading the image data of a particular character from an image data memory 8, which image data is stored in the image data memory 8, which will be described later. Specifically, each character name represents the particular character, and also, actually represents the top-left corner dot of the character rectangle of the character.

Figure 2:
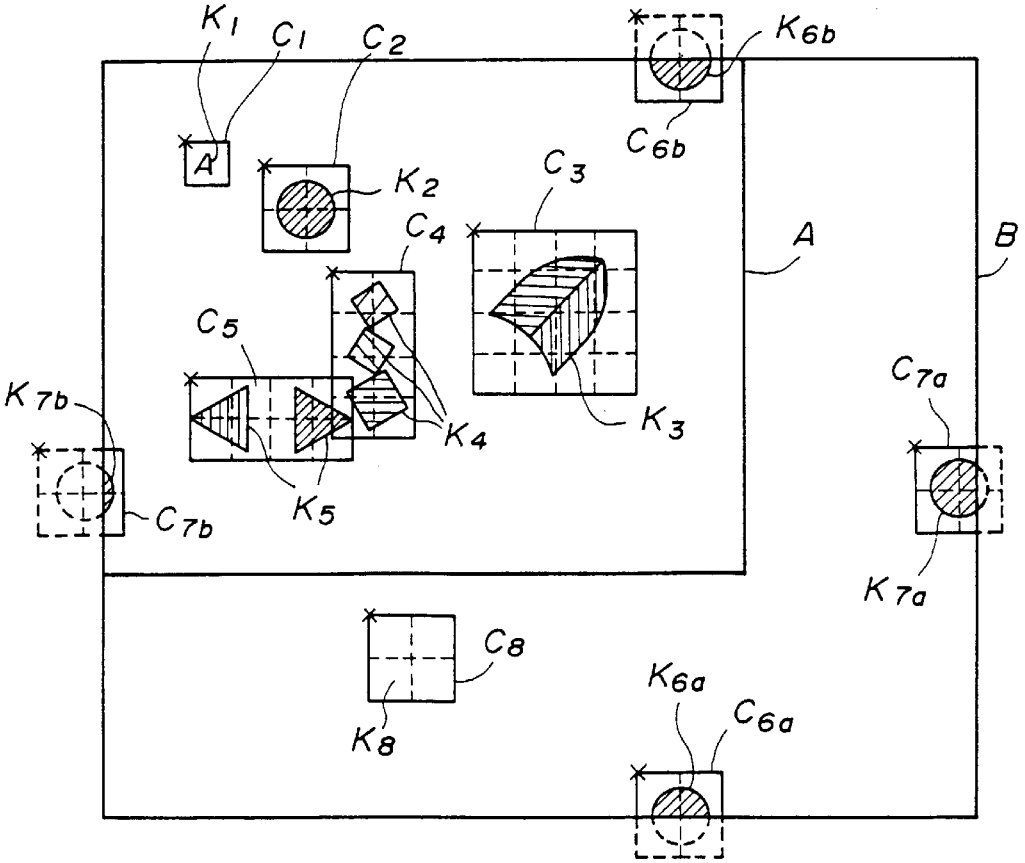
FIG. 2 illustrates a spatial relationship between an imaginary screen image, a display screen image and respective character images in the embodiment of the present invention.

The size of each character is not fixed. As shown in FIG. 2, various sizes of characters are provided. With reference to FIG. 2, a smaller rectangle 'A' represents a display screen image and a larger rectangle 'B' represents an imaginary screen image. Various character images $K_1$, $K_2$, $K_3$, . . . are placed in the imaginary screen image B. Each character image of the character images $K_1$, $K_2$, $K_3$, . . . is provided in a respective character rectangle $C_1$, $C_2$, $C_3$, . . . For example, the character image $K_1$ is provided in a character rectangle $C_1$ which has a basic size of 8 dots by 8 dots. Each of character rectangles $C_2$, $C_6$, $C_7$ and $C_8$ is a character rectangle of a size which is twice the basic size in the horizontal direction by twice the basic size in the vertical direction. A character rectangle $C_3$ is a character rectangle of a size which is four times the basic size in the horizontal direction by four times the basic size in the vertical direction. A character rectangle $C_4$ is a character rectangle of a size which is twice the basic size in the horizontal direction by four times the basic size in the vertical direction. A character rectangle $C_5$ is a character rectangle of a size which is four times the basic size in the horizontal direction by twice the basic size in the vertical direction. With regard to the character rectangle $C_6$, the portion thereof within the imaginary screen image B but outside of the display screen image A is referred to as $C_{6a}$ and the remaining portion within the display screen image A is referred to as $C_{6b}$. The portion $C_{6a}$ is the upper half of the character rectangle $C_6$ while the portion $C_{6b}$ is the lower half of the character rectangle $C_6$. It may be considered that, first, the entirety of the character rectangle $C_6$ is located at the bottom area of the imaginary screen image B. Then, the character rectangle $C_6$ is moved downwardly. Finally, the bottom of the character rectangle $C_6$ reaches the bottom line of the imaginary screen image B. After that, when further moving the character rectangle $C_6$ downwardly, a bottom portion thereof appears at the top the display screen image A. Then, the character rectangle $C_6$ is further moved downwardly. Thus, the state shown in FIG. 2 is provided. Similarly, with regard to the character rectangle $C_7$, the portion within the imaginary screen image B but outside of the display screen image A is referred to as $C_{7a}$, and the remaining part within the display screen image A is referred to as $C_{7b}$. It may also be considered that, first, the entirety of the character rectangle $C_7$ is located at the right edge area of the imaginary screen image B. Then, the character rectangle $C_7$ is moved rightwardly. Finally, the right edge of the character rectangle $C_7$ reaches the right edge line of the imaginary screen image B. After that, when further moving the character rectangle $C_7$ rightwardly, a right edge portion thereof appears at the left edge the display screen image A. Then, the character rectangle $C_7$ is further moved rightwardly. Thus, the state shown in FIG. 2 is provided. The entirety of the character rectangle $C_8$ is located in the imaginary image screen B but outside of the display screen image A.

By giving coordinate values as the horizontal display coordinate and the vertical display coordinate in the above-described attribute data shown in FIG. 3, which coordinate values represent a coordinate position outside the display screen image, a character rectangle can be located outside of the display screen image. Only characters and portions of characters which are located within the display screen image can be actually displayed on the scanning-type display.

In FIG. 2, the 'x' mark given at the top-left corner of each character rectangle represents a display starting position thereof. The above-mentioned vertical display coordinate and horizontal display coordinate of the attribute data specify this display starting position.

Figure 4:
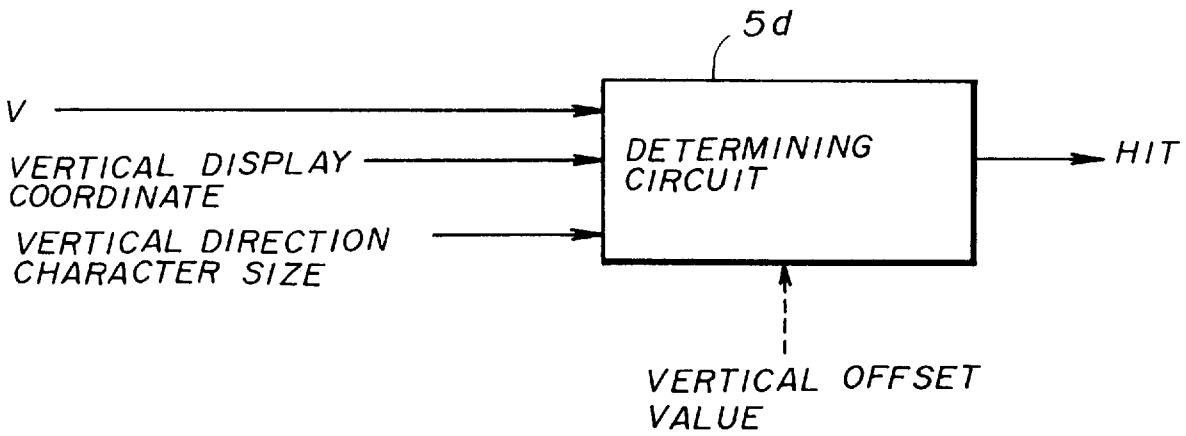
FIG. 4 illustrates a relationship between a determining circuit of the first writing control circuit and signals input thereto in the embodiment of the present invention.

A first writing control unit 5 reads the attribute data from the character table unit 4 for the respective #0 to #127 characters in the stated order. Based on the read attribute data, the first writing control unit 5 determines whether or not those characters are displayed in a current horizontal period. For this purpose, the first writing control circuit 5 includes a determining circuit 5*d* as shown in FIG. 4. The determining circuit 5*d* receives the vertical display coordinate and vertical direction character size, which actually indicates the size of the character rectangle of each character (similarly, the horizontal direction character size actually indicates the size of the character rectangle of each character), of the attribute data, and recognizes at which scanning line of the display screen image A (or the imaginary screen image B) starts display of each of the character rectangles of those characters and for which scanning lines the character rectangle is displayed. Further, the determining circuit 5*d* receives the vertical count value V and thereby recognizes the current scanning line. The determining circuit 5*d* determines whether each character rectangle should be displayed on the current scanning line and in the current horizontal period. Determining that a character rectangle should be displayed in a current horizontal period will be referred to as 'hit', hereinafter. When a hit occurs, a hit signal ('HIT') is provided by the determining circuit 5*d*.

When a character rectangle is determined to be displayed in a current horizontal period, the first writing control circuit 5 modifies the attribute data of the character and writes the modified attribute data to a hit buffer (second storage device) 6. The first writing control circuit 5 further includes a first modifying unit 5*a*, a second modifying unit 5*b* and a third modifying unit 5*c*, as shown in FIG. 3.

Figure 6A:
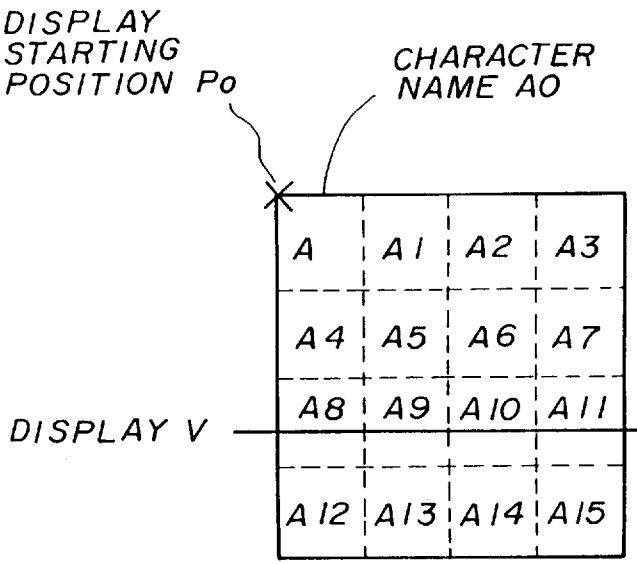
FIGS. 6A and 6B show a relationship between a character rectangle (each character rectangle may be referred to as simply a character), and basic size character rectangles (each basic size character rectangle may be simply referred to as a basic size character) which constitutes the character rectangle in the embodiment of the present invention, FIG. 6A showing a state in which a current display position is located in basic size character rectangles A8 to A11, FIG. 6B illustrating basic size character names and Y-line in basic size attribute data which is produced from the attribute data of the character (character rectangle) shown in FIG. 6A.
Figure 6B:
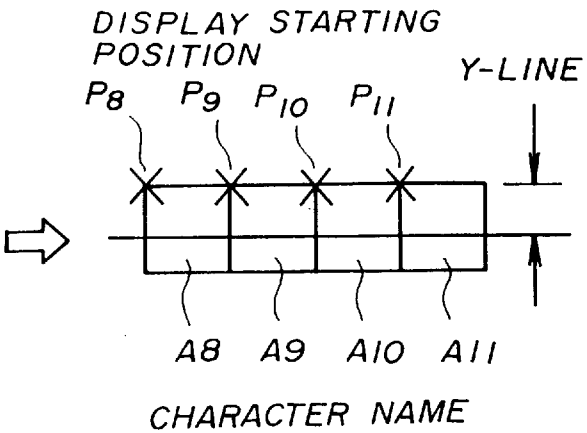

The first modifying unit 5*a* receives the character name, horizontal direction character size, vertical direction character size, X inversion flag and Y inversion flag from the character table unit 4. The first modifying unit 5*a* produces basic size character names and writes them in the hit buffer 6. For example, as shown in FIG. 6, the character rectangle of a character name A0 consists of 4 by 4 in horizontal and vertical directions, 16 basic size character rectangles (each basic size character rectangle having the size of 8 dots by 8 dots), having basic size character names A0 to A15. Although no character image is actually shown in the figure in the character rectangle consisting of the 16 basic size character rectangles, the 16 basic size character rectangles A0 to A15 have respective divisions of the character image, respectively (as an example, see the character rectangle $C_3$ and the character $K_3$ in FIG. 2, where some basic size character rectangle, which is located at the periphery of the whole character rectangle, may not actually contain a character image division). Each basic size character name represents the particular basic size character rectangle, and also, in this embodiment, represents the top-left corner dot of the basic size character rectangle. A display (current) scanning line is located in the series of the basic size character rectangles having basic size character names A8 to A11 respectively. In this case, the first modifying unit 5*a* produces the basic size character names A8, A9, A10 and A11.

Specifically, based on the spatial relationship (actually, the vertical distance) between the display starting position $P_0$ of the character rectangle of character A0 and the display (current) scanning line, the basic size character name A8 is produced. Because the size of each basic size character rectangle is fixed as 8 dots by 8 dots, when address resulting from adding the vertical address difference between the display starting position $P_0$ and the display scanning line to the display starting position $P_0$ is in a middle of the basic size character rectangle A8, it can be determined that the scanning line passes through the basic size character rectangle A8. Thus, the basic size character name A8 is obtained. As the size of each basic size character rectangle is 8 dots by 8 dots, by adding the horizontal 8-dot address difference to the address of the basic size character rectangle A8, the address of the basic size character rectangle A9 which should be subsequently displayed on the display scanning line is determined. Thus the basic size character name A9 is obtained. Similarly, the basic size character names A10 and A11 are also obtained. Thus, the four basic size character names A8 to A11 are produced.

Each basic size character name indicates the address of the image data of the respective basic size character rectangle, which address is used for reading the image data from the image data memory 8.

It is assumed that each of the X inversion flag and Y inversion flag is "0", and no character inversion is performed. With regard to X inversion and Y inversion, descriptions will be given later.

The second modifying unit 5*b* receives the vertical direction character size, vertical display coordinate, Y inversion flag and vertical count value V. The second modifying unit 5*b* produces a Y-line. In the above-mentioned example, as shown in FIG. 6, the Y-line represents the number of dots between the top and the display position of the basic size character rectangles A8, A9, A10 and A11.

The third modifying unit 5*b* receives the horizontal character size, the horizontal display coordinate and a horizontal offset. The third modifying unit 5*b* produces a basic size horizontal display coordinate. In the above-mentioned example, with reference to FIG. 6, the basic size horizontal display coordinate represents a horizontal coordinate value (X coordinate value) of each of the display starting positions $P_8$, $P_9$, $P_{10}$ and $P_{11}$ of the basic size character rectangles A8, A9, A10 and A11, respectively.

Figure 5:
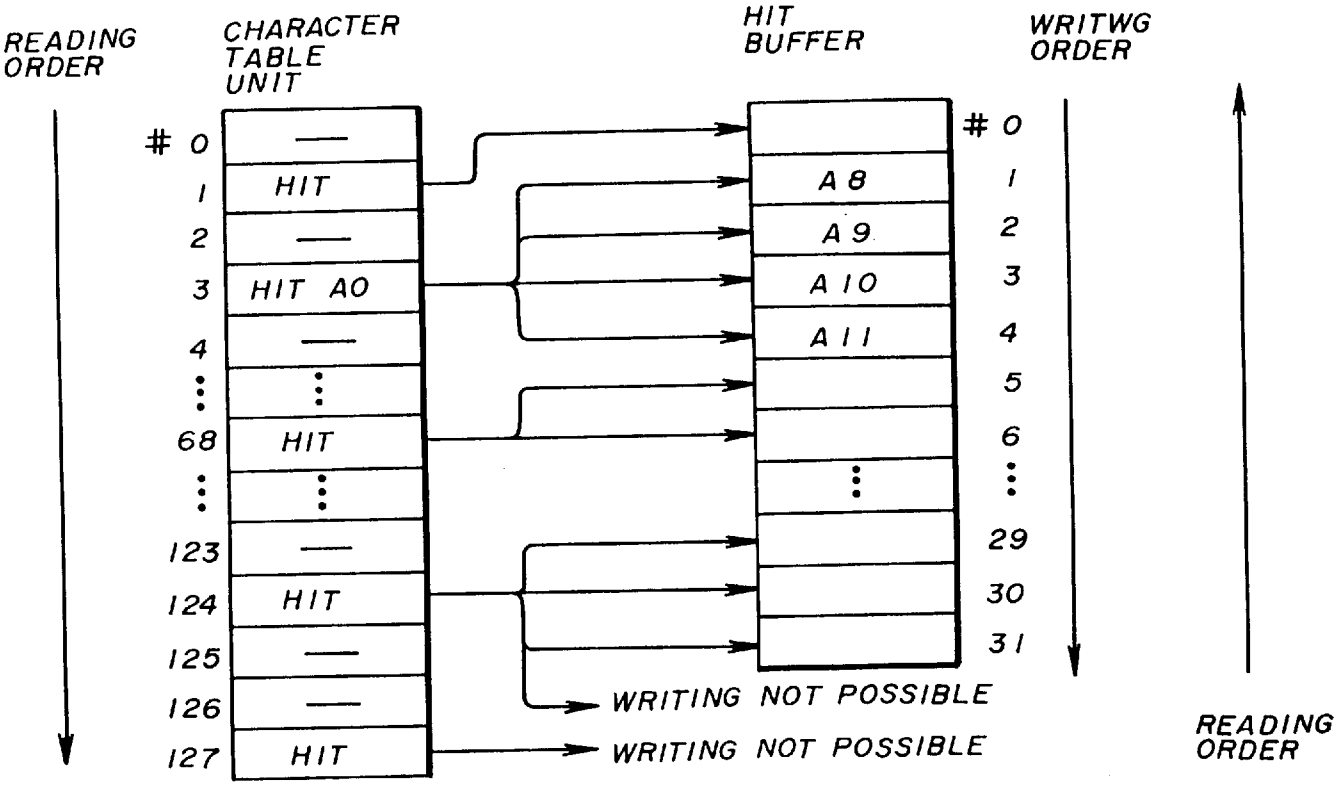
FIG. 5 shows a concept of a specific relationship between the character table unit and hit buffer, and reading and writing orders in the embodiment of the present invention.

In the above-mentioned example of FIG. 6, as shown in FIG. 5, for the character A0, the hit buffer 6 stores the attribute data of the four basic size character rectangles A8, A9, A10 and A11. In this embodiment, the hit buffer has a storage capacity of the attribute data of 32 (#0 to #31) basic size character rectangles. In other words, in this embodiment, 32 basic size character rectangles can be displayed in one horizontal period.

When the character rectangles of hit characters consists of a number of basic size character rectangles, which number is more than 32, the attribute data of the first 32 basic size character rectangles are stored, but the attribute data of the remaining basic size character rectangles are not stored in the hit buffer 6. In the example of FIG. 5, the character #124 of the character table unit 4 consists of four basic size character rectangles, the attribute data of the first three basic size character rectangles are stored in the hit buffer, but the attribute data of the last basic size character rectangle is not stored therein. As shown in FIG. 5, a reading of the attribute data from the hit buffer 6 is performed in an order reverse to the order in which the writing of the attribute data in the hit buffer 6 was performed. Therefore, a FIFO (First-In, First-Out) register can be used as the hit buffer 6. By providing the attribute data of a more important character stored in a lower number of #0 to #127 of the character table unit 4, the attribute data of a more important character is read from the character table unit 4 earlier, is written in the hit buffer earlier, and also read from the hit buffer later. Being read from the hit buffer 6 later means that the image data is later written (overwritten) in a line buffer 9 shown in FIG. 1. Thus, the possibility that a more important character is actually displayed on the scanning-type display is higher.

A second writing control circuit 7 shown in FIG. 1 produces an address based on the basic size character name and Y-line of the attribute data of a basic size character rectangle which is read from the hit buffer 6 for each basic size character rectangle stored therein. The address is provided to the image data memory 8, and the image data of the basic size character rectangle on the current scanning line is read from the image data memory 8. The second writing control circuit 7 writes the read image data in the line buffer 9 at a predetermined address based on the basic size horizontal display coordinate of the attribute data of the basic size character rectangle read from the hit buffer as mentioned above. When image data thus read from the image data memory 8 is a code indicating a transparency (for example, all the bits being "0"), the image data is not written in the line buffer 9. The line buffer 9 stores image data for one horizontal period. How the color selection flag is used will be described later, together with descriptions of a color look-up table unit 10 shown in FIG. 1.

The image data stored in the line buffer 9 is read by reading means (not shown in the figure) in synchronization with the above-mentioned horizontal count value. The color look-up table unit 10 converts the thus-read image data into RGB signal, and provides it to an image display device (not shown in the figure). When the address of the color look-up table unit 10 includes 8 bits and image data read from the line buffer is 4-bit data, it is necessary to provide other 4-bit data so as to fill in the 8-bit address of the color look-up table unit 10. The second writing control circuit 7 uses the 2-bit data of the color selection flag of the attribute data of the basic size character rectangle from the hit buffer 6. Using the 2-bit color selection flag, the second writing control circuit 7 produces 4-bit supplementary data, added to the 4-bit image data and fills in the 8-bit address of the color look-up table unit 10, where the 4-bit supplementary data is arranged at the most significant side and the 4-bit image data is arranged at the least significant side. The 4-bit supplementary data is used to determine the color of the character in the color look-up table unit 10. Although basic image data is of 4 bits, by adding other 4-bit supplementary data thereto, various colors can be provided for particular characters.

Figure 7:
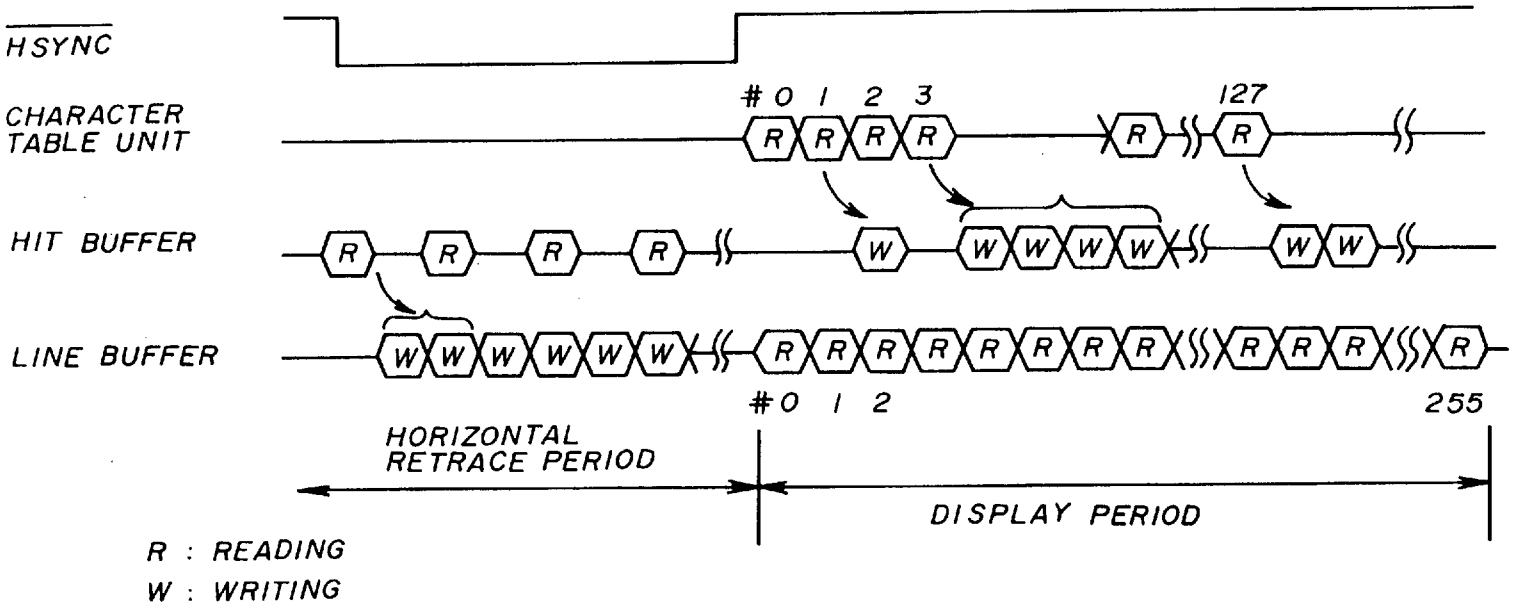
FIG. 7 shows a time chart of data writing and reading timing in the embodiment of the present invention.

FIG. 7 shows a time chart of data reading and writing between the character table unit 4, hit buffer 6 and line buffer 9 for one horizontal period. The second writing control circuit 7 reads attribute data from the hit buffer 6, reads image data based on the read attribute data, and writes the image data in the line buffer 9, during the horizontal retrace period. The image data written in the line buffer 9 is read during the display period. Further, during the display period, for producing image data to be subsequently written in the line buffer 9, the first writing control circuit 5 reads attribute data from the character table unit 4, modifies it into basic size attribute data (such as that shown in FIG. 3, stored in the hit buffer 6) and writes it in the hit buffer 6.

When each dot of image data is read from the line buffer 9, a transparency code (for example, all bits being "0") is written in and thus clears the dot of the line buffer 9. The subsequent dot of the image data is read from the line buffer 9. As shown in FIG. 7, as one unit of data is read from the hit buffer, two units of data is written in the line buffer 9. This means that, for example, as each basic size character rectangle has the horizontal length of 8 dots and each dot includes 4-bit data, the total 32-bit data is processed. When one word of the image data memory 8 includes 16 bits, in order to obtain 32-bit data, it is necessary to perform two reading operations from the image data memory, and two writing operations in the line buffer 9. Thus, as one unit of data is read from the hit buffer 6, two units (two writing operations) of data is written in the line buffer 9.

In summary, when a character stored in the character table unit 4 has a size corresponding to a plurality of basic sizes, the first writing control circuit 5 produces the attribute data of basic size divisions of the character on the hit buffer 6 based on the attribute data of the character. Then, the second writing control circuit 7 read image data from the image data memory 8 in accordance with the attribute data of the basic size divisions of the character and writes the image data in the line buffer.

Thereby, it is possible to display various sizes of characters in a mixed manner, through a relatively simple configuration. Especially, the second writing control circuit 7 processes basic size divisions of characters, that is, substantially processes basic size characters, reads image data from the image data memory 8, and writes it in the line buffer 9. In comparison to the above-mentioned prior art in which image data is processed based on horizontal display size information, accessing of the image data memory 8 can be efficiently performed. In this embodiment, it is possible to increase the number of characters which can be easily displayed. In comparison to the above-mentioned related art in which two sets of row buffers and column buffers are used, a relatively simple hard configuration can perform necessary processing. Therefore, it is easy to form an LSI circuit of this embodiment.

It is possible to place characters in the imaginary screen image B to be larger than the display screen image A, as shown in FIG. 2, merely by giving appropriate values for the horizontal and vertical display coordinates of the attribute data of the characters. By gradually changing these display coordinate values, it is possible that a character appears, moves vertically or horizontally, and disappears, smoothly, on the scanning-type display. By giving coordinate values outside of the display screen image A, it is possible to prevent a character from being displayed on the scanning-type display.

As mentioned above, when a number of basic size character rectangles of hit characters is more than 32, the attribute data of the remaining basic size character rectangles is not stored in the hit buffer 6. Thereby, a defective character may be created. When the display coordinates of the attribute data of respective characters overlap or are near to each other, these characters are displayed in an overlapping manner as a result of the image data being overwritten on the line buffer 9. If the image data of such a defective character were read last from the hit buffer 6, the defective character might cover non-defective character, the image data of which were previously read, when displayed on the scanning-type display. However, in this embodiment, as mentioned above, the order in which attribute data is read in the hit buffer 6 is reverse to the order in which the attribute data was written. Therefore, such a problem should not occur. That is, a defective character, if any, should not cover another non-defective character when displayed on the scanning-type display.

By merely setting the hit buffer 6 reading order reverse to the writing order, even if so many characters are set in the character table unit 4 that the number of basic size character rectangles of hit characters is more than the number (32), which can be displayed for one horizontal period, the possibility of being displayed on the scanning-type display is higher for a character, the attribute data of which is written in a lower number of the storage areas (#0 to #127) of the character table unit 4. Display priority is higher for a character, the attribute data of which is written in a lower number of the storage areas (#0 to #127) of the character table unit 4. Such a display priority setting can be easily achieved by merely setting the hit buffer 6 reading order reverse to the writing order. Therefore, a complicate circuit configuration is not needed.

Figure 8:
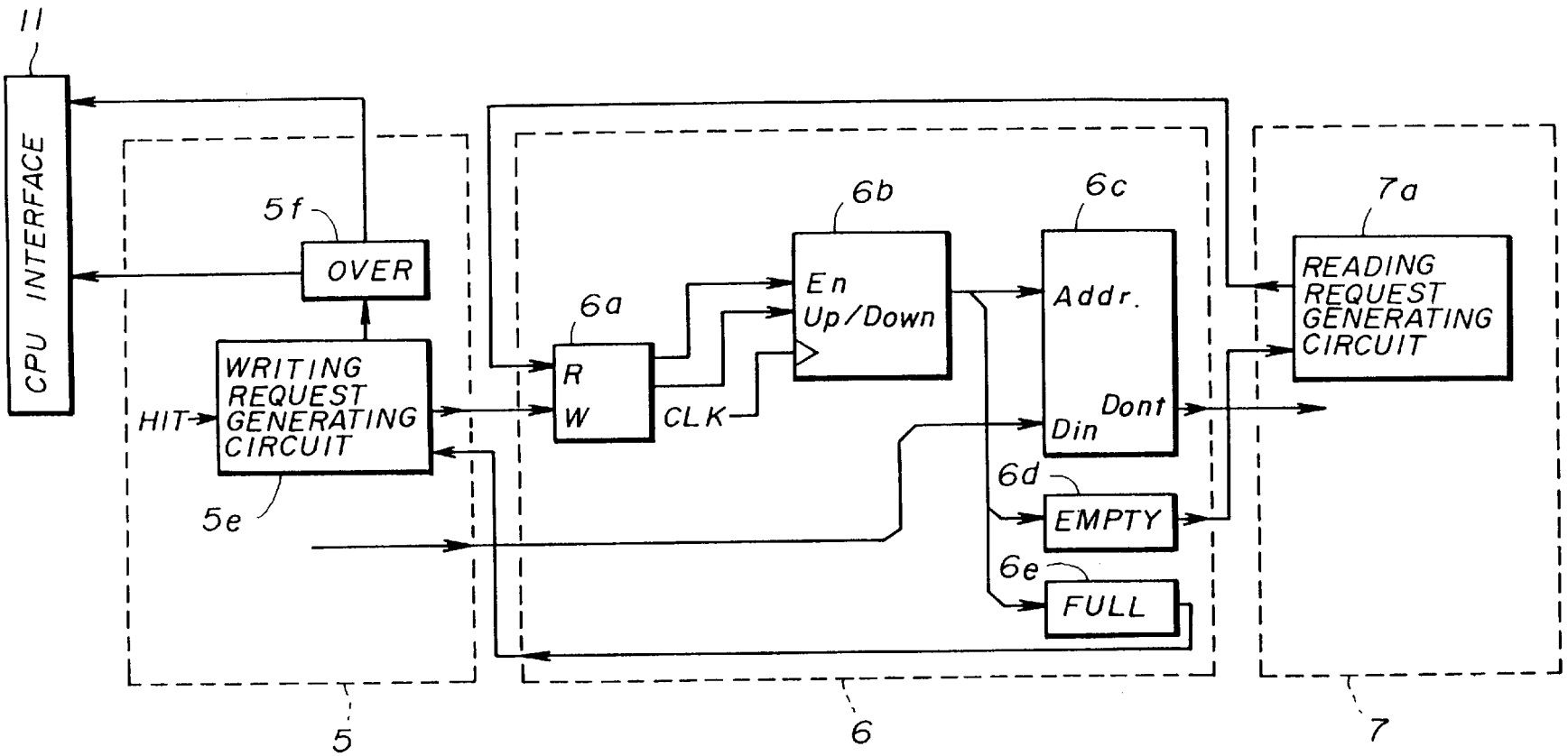
FIG. 8 shows a block diagram of a specific relation between the first writing control circuit, hit buffer and a second writing control circuit in the embodiment of the present invention.

With reference to FIG. 8, a relationship between the first writing control circuit 5, hit buffer 6 and second writing control circuit 7 will be described in further detail.

The first writing control circuit 5 includes a writing request generating circuit 5*e*. The writing request generating circuit 5*e* receives the hit signal (HIT) from the determining circuit 5*d* (not shown in FIG. 8). When the hit signal is provided, the writing request generating circuit 5*e* provides a signal for requesting writing to a writing and reading control unit 6*a* of the hit buffer 6.

The writing and reading control unit 6*a*, based on this writing request signal and a reading request signal from a reading request generating circuit 7*a*, switches between writing to and reading from a memory unit 6*c* of attribute data.

Up/Down (writing and reading order) of an address generating circuit 6*b* of the hit buffer 6 is appropriately switched by the writing and reading control unit 6*a* when the writing and reading control unit 6*a* receives the writing request and receives the reading request. According to the thus-determined order, the address generating circuit 6*b* generates addresses to the memory unit 6*c*. According to the addresses, the basic size attribute data is written in the memory unit 6*c*, and is read therefrom.

The addresses from the address generating circuit 6*b* are also supplied to an EMPTY flag unit 6*d* and a FULL flag unit 6*e*. The EMPTY flag unit 6*d* provides a flag "1" when receiving the top address (#0 of the hit buffer 6 shown in FIG. 6) of the memory unit 6*c* and thereby determines that the memory unit 6*c* is empty.

The second writing control circuit 7 continues to read attribute data from the hit buffer 6 and writes image data in the line buffer 9, until the EMPTY flag unit 6*d* provides the flag "1". The second writing control circuit 7 stops the reading of attribute data when the EMPTY flag unit 6*d* provides the flag "1".

When receiving the last address (#31 in the hit buffer 6 shown in FIG. 5) of the memory unit 6*c*, the FULL flag unit 6*e* determines that no storage space remains in the memory unit 6*c* and provides a flag "1". When the hit signal is provided in the condition where the FULL flag unit 6*e* provides "1", the writing request generating circuit 5*e* causes an OVER flag unit 5*f* of the first writing control circuit 5 to provide a flag "1". A CPU (not shown in the figure) can see the state of the OVER flag unit 5*f* through a CPU interface 11. Further, the flag "1" from the OVER flag unit 5*f* can interrupt an operation of the CPU via the CPU interface 11. The flag "1" from the OVER flag unit 5*f* means that the hit buffer 6 has an overflow and attribute data cannot be written in the hit buffer. As a result, a defective character may occur or a character cannot be displayed. The CPU can recognize such a situation by recognizing the flag "1" from the OVER flag unit 5*f*. In response thereto, the CPU may perform processing for preventing a low-priority-order character from being hit, processing for rearranging attribute data stored in the character table unit 4, and processing for checking a software.

Figures 9A, 9B, 9C:
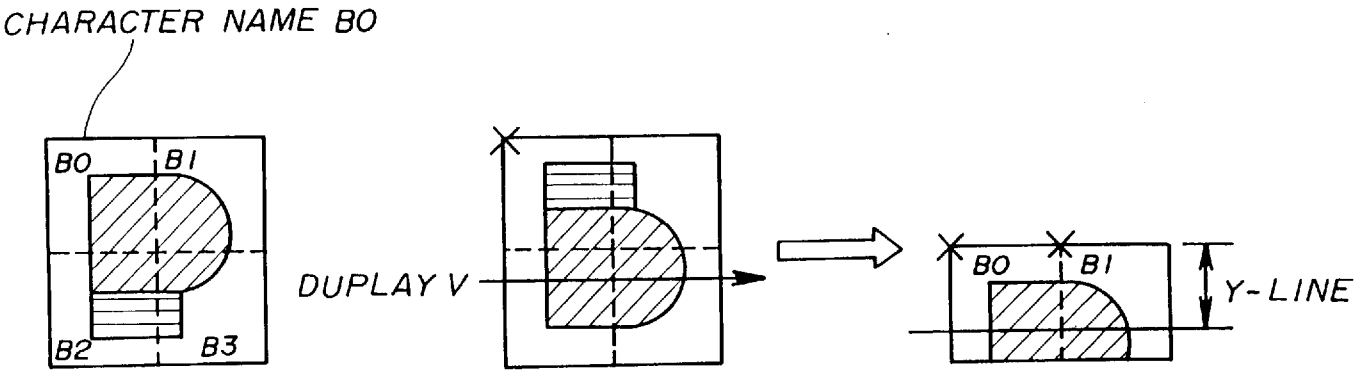
FIGS. 9A, 9B and 9C illustrate inversion processing in the embodiment of the present invention, FIG. 9A showing a character image, FIG. 9B showing a Y inverted state of the character image.

The X inversion and Y inversion will now be described. The X inversion is to invert a character rectangle in a manner in which an inverting axis is the vertical center axis of the character rectangle. That is, the character rectangle is turned between the left and right, and the left half and right half of the character rectangle are replaced by one another. Similarly, the Y inversion is to invert a character rectangle in a manner in which an inverting axis is the horizontal center axis of the character rectangle. That is, the character rectangle is turned upside down, and the upper half and lower half of the character rectangle are replaced by one another. For example, when the Y inversion is performed on a character rectangle "B0" consisting of four basic size character rectangles (B0, B1, B2 and B3), a character rectangle shown in FIG. 9B is obtained.

When performing the Y inversion, the arrangement of basic size character rectangles is turned upside down. In each basic size character rectangle, the arrangement of the dots are turned upside down. However, in each basic size character rectangle, the arrangement of the dots is not turned between the left and right. When the Y inversion flag shown in FIG. 3 is "1", the first modifying unit 5*a* of the first writing control circuit 5 receives the Y inversion flag "1". When the display scanning line passes through the lower half of the character rectangle as shown in FIG. 9B, image data of B0, B1 should be provided, as shown in FIG. 9C, as the Y inversion has been performed on the character rectangle shown in FIG. 9A. The first modifying unit 5*a* writes the attribute data of the basic size rectangle names B0, B1 in the hit buffer 6 for the current display scanning line (represented by the vertical count value 'V'). The second modifying unit 5 produces a Y-line. After undergoing the Y inversion, the Y-line is such as that shown in FIG. 9C for the position of the current display scanning line shown in FIG.

9B. The Y-line after Y inversion is obtained from reducing the Y-line before Y inversion from the vertical size of a basic size character rectangle. Specifically, when Y-line data before the Y inversion has a bit arrangement "010", the Y-line data after the Y inversion has a bit arrangement "101". That is, each bit of the original bit arrangement is inverted ("1"→"0", "0"→"1"). Thus, no complicate circuit configuration needs to be applied for this purpose.

When performing the X inversion, the arrangement of basic size character rectangles is turned between the left and right, and also the dot arrangement of each basic size character rectangles is turned between the left and right. However, the arrangement of the basic size character rectangles is not turned upside down. Therefore, when the X inversion flag is "1", the first modifying unit 5*a* of the first writing control circuit, which receives this flag, writes the attribute data of basic size character rectangles in the hit buffer 6 in the reverse order. As shown in FIG. 3, the X inversion flag is stored in the hit buffer 6. The second writing control circuit 7, which receives the X inversion flag "1", writes image data of respective basic size character rectangles in a manner in which the dot arrangement of each basic size character rectangle is inverted.

Figure 10:
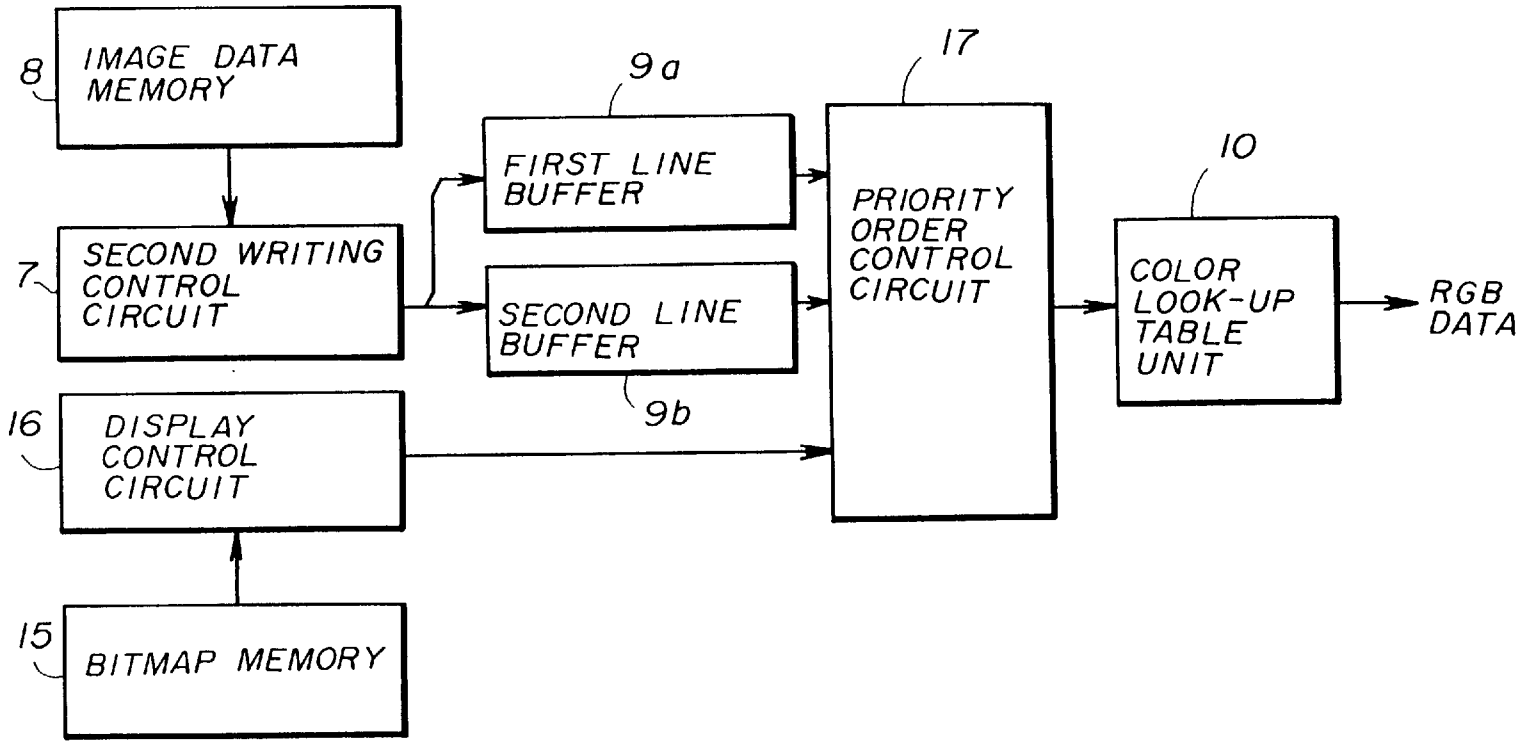
FIG. 10 shows a block diagram of a general configuration of the image display control device in a first variant example of the embodiment of the present invention, using two line buffers.

With reference to FIG. 10, a configuration provided with a first line buffer 9*a* and a second line buffer 9*b* will now be described. The purpose for providing the first and second line buffer 9*a*, 9*b* will now be described. When a character of a picture of the "sun" and a character of a picture of an "airplane" are displayed at a common screen image position, the "airplane" character should be displayed in a higher priority. A purpose of providing the first and second line buffer 9*a*, 9*b* is to simply perform such priority processing.

For this purpose, in the character table unit 4 shown in FIG. 3, a display selection flag is added as attribute data, and is transferred to the hit buffer as it is. In the above-mentioned example, the display selection flag of the attribute data of the "airplane" character is made to be "1". The second writing control circuit 7 writes image data in the first line buffer 9*a* when the display selection flag is "1", and write image data in the second line buffer 9*b* when the display selection flag is reset to be "0". Output image data from the first and second line buffers 9*a* and 9*b* is provided to the color look-up table unit 10 via a priority order control circuit 17.

A background screen image (for example, a screen image of mountains) is stored in a bitmap memory 15. A display control circuit 16 reads image data from the bitmap memory 15. The read image data is provided to the color look-up table unit 10 via the priority order control circuit 17.

Figure 11:
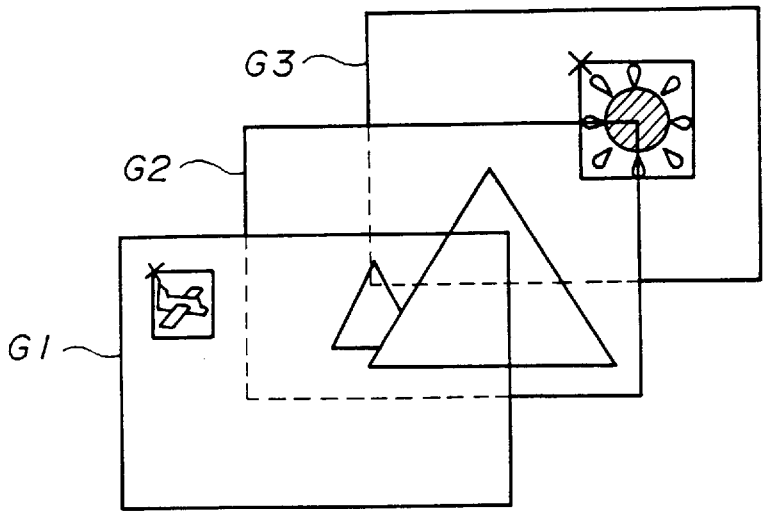
FIG. 11 shows a relationship between a bitmap screen image, a first line buffer screen image, and second line buffer screen image in the image display control device shown in FIG. 10.

A display screen image G1 provided from the first line buffer 9*a*, a background screen image G2 provided from the bitmap memory 16 and a display screen image G3 provided from the second line buffer 9*b*, shown in FIG. 11, are superimposed on each other. A priority order of these image screens G1, G2 and G3 is the above-stated order.

The priority order control circuit 17 receives image data from the first and second line buffers 9*a*, 9*b* and bitmap memory 17 via the display control circuit 16. When each image data is image data which is not a transparency code, the image data from the first line buffer 9*a* is selectively used. When the image data from the first line buffer 9*a* is the transparency code, and each of the other two image data is image data which is not transparency data, the image data from the bitmap memory 15 is selectively used. When each of the image data from the first line buffer 9*a* and the image data from the bitmap memory 15 is a transparency code and only the image data of the second line buffer 9*b* is image data which is not transparency data, the image data from the second line buffer 9*b* is selectively used.

The priority order control circuit 17 can change the priority order. For example, G2 has a priority higher than that of G1. Thereby, a display such as, for example, when the "airplane" flies from the left to the right, it flies in front of the "mountains", and when the "airplane" flies from the right to the left, it flies behind the "mountains", is possible. It is also possible that more than two, i.e., many line buffers are used and a display priority order between image data from many such line buffers are controlled by the priority order control circuit 17.

In the above-described example, the display selection flag is used for determining in which of the first and second line buffers image data is written. However, another method for the same purpose can be considered. For example, a method of using a boundary register (not shown in the figure) will now be described. The boundary register stores an address of the character table unit 4, by which address the character table unit 4 is divided into two divisions. When the first writing control circuit 5 modifies attribute data of the character table unit 4 and stores it in the hit buffer 6, compares the address of the attribute data in the character table unit 4 and the address stored in the boundary register. The first writing control circuit 5 writes the comparison result in the hit buffer 6. When the second writing control circuit 7 writes image data in the line buffers based on basic size attribute data of the hit buffer 6, the second writing control circuit 7 writes image data selectively between the first and second line buffers 9*a*, 9*b* based on the comparison result.

Figure 12:
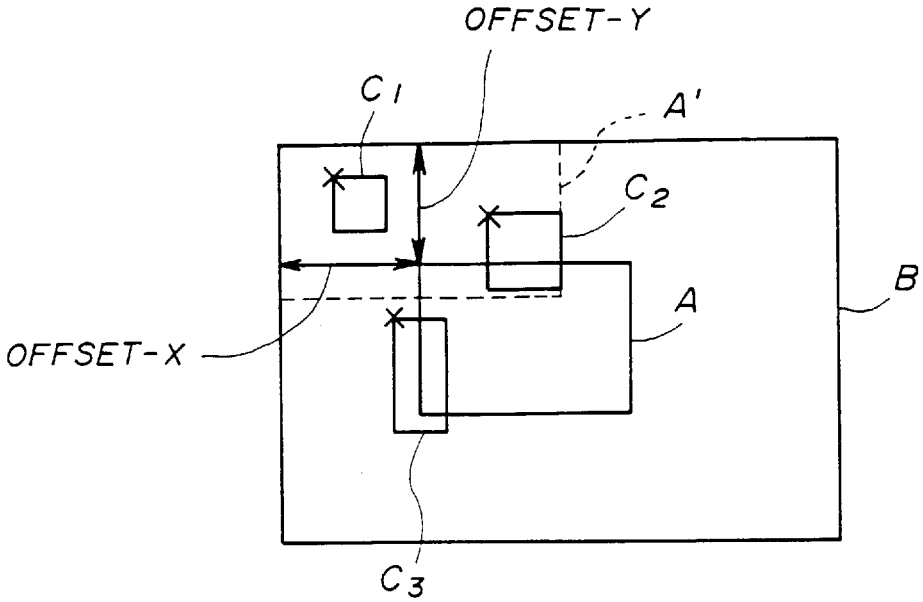
FIG. 12 shows offset processing in the embodiment of the present invention.

With reference to FIG. 12, offset processing will now be described. The offset processing is processing useful in image screen display in a car navigation system in which respective characters displayed on a screen image are moved or scrolled all together in the same direction. In the offset processing, as shown in FIG. 12, the display screen image A is shifted with respect to the coordinate system, thereby, with respect to the character rectangle and the imaginary screen image B according to a horizontal distance OFFSET-X and a vertical distance OFFSET-Y. For example, when the OFFSET-X=0 and OFFSET-Y=0, the display screen image A is located at the position A' indicated by a broken line, that is, the display screen image is located at the top-left corner of the imaginary screen image as in FIG. 2. With regard to character rectangles $C_1$, $C_2$, $C_3$, the character rectangles $C_1$ and $C_2$ are included in the display screen image A, and the character rectangle $C_3$ is outside of the display screen image A. Therefore, the character rectangle $C_1$ and $C_2$ are actually displayed on the scanning-type display but the character rectangle $C_3$ is not actually displayed. However, the display screen image A is in the position indicated by a solid line by the OFFSET-X and OFFSET-Y, that is, located at a middle of the imaginary screen image B. The character rectangle $C_1$ is not actually displayed and a bottom part of the character rectangle $C_2$ and a top-right part of the character rectangle $C_3$ are actually displayed. For providing such offset processing, two offset registers for storing a vertical offset value indicating the OFFSET-Y and a horizontal offset value indicating the OFFSET-X, respectively, are provided.

When vertical offset processing is performed, the determining circuit 5*d* shown in FIG. 4 receives the vertical offset value from the offset register. The determining circuit 5*d* added the vertical offset value to the vertical count value V. The added result of the vertical count value indicates the Y coordinate value within the display screen image A. By comparing the added result of the vertical count value with the vertical display coordinate and vertical direction character size, it is determined by the determining circuit 5*d* that the current display scanning line passes through (hits) the particular character rectangle. When horizontal offset processing is performed, the third modifying unit 5*c* shown in FIG. 3 receives the horizontal offset value from the offset register. The third modifying unit 5*c* subtracts the horizontal offset value from the basic size horizontal display coordinate and writes the subtracted result in the hit buffer 6. The basic size horizontal display coordinate stored in the hit buffer 6 is a coordinate value in a coordinate system with respect to the display screen image A. Thus, the offset processing is easily performed.

Figure 13:
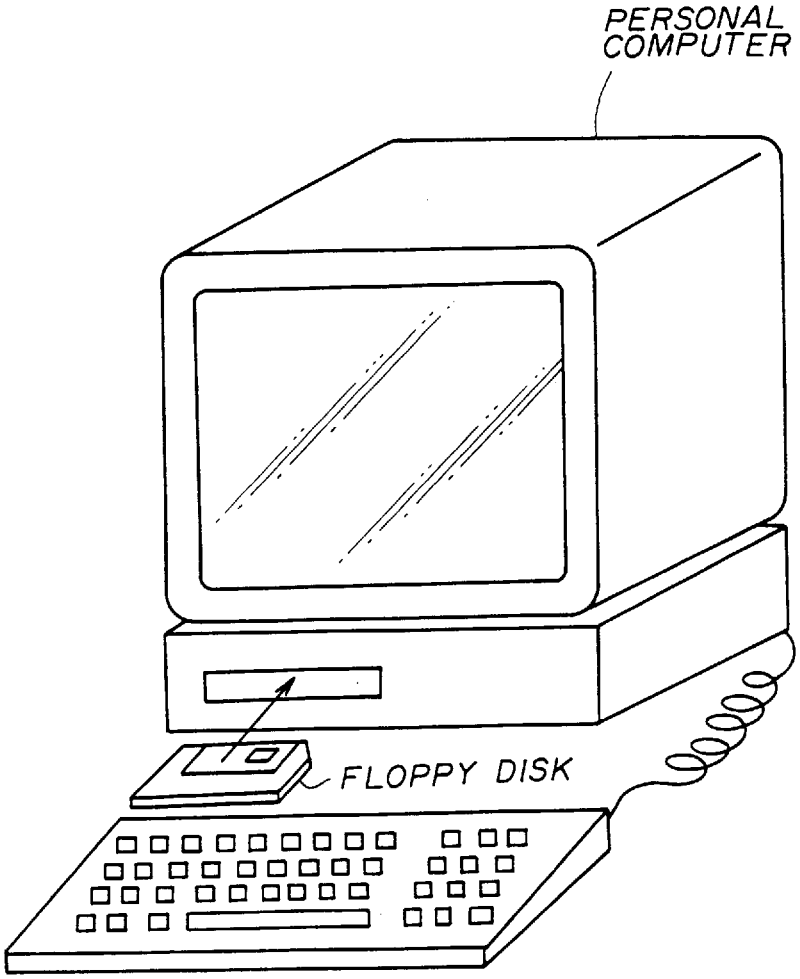
FIG. 13 shows a configuration of a second variant example of the embodiment of the present invention.
Figure 14:
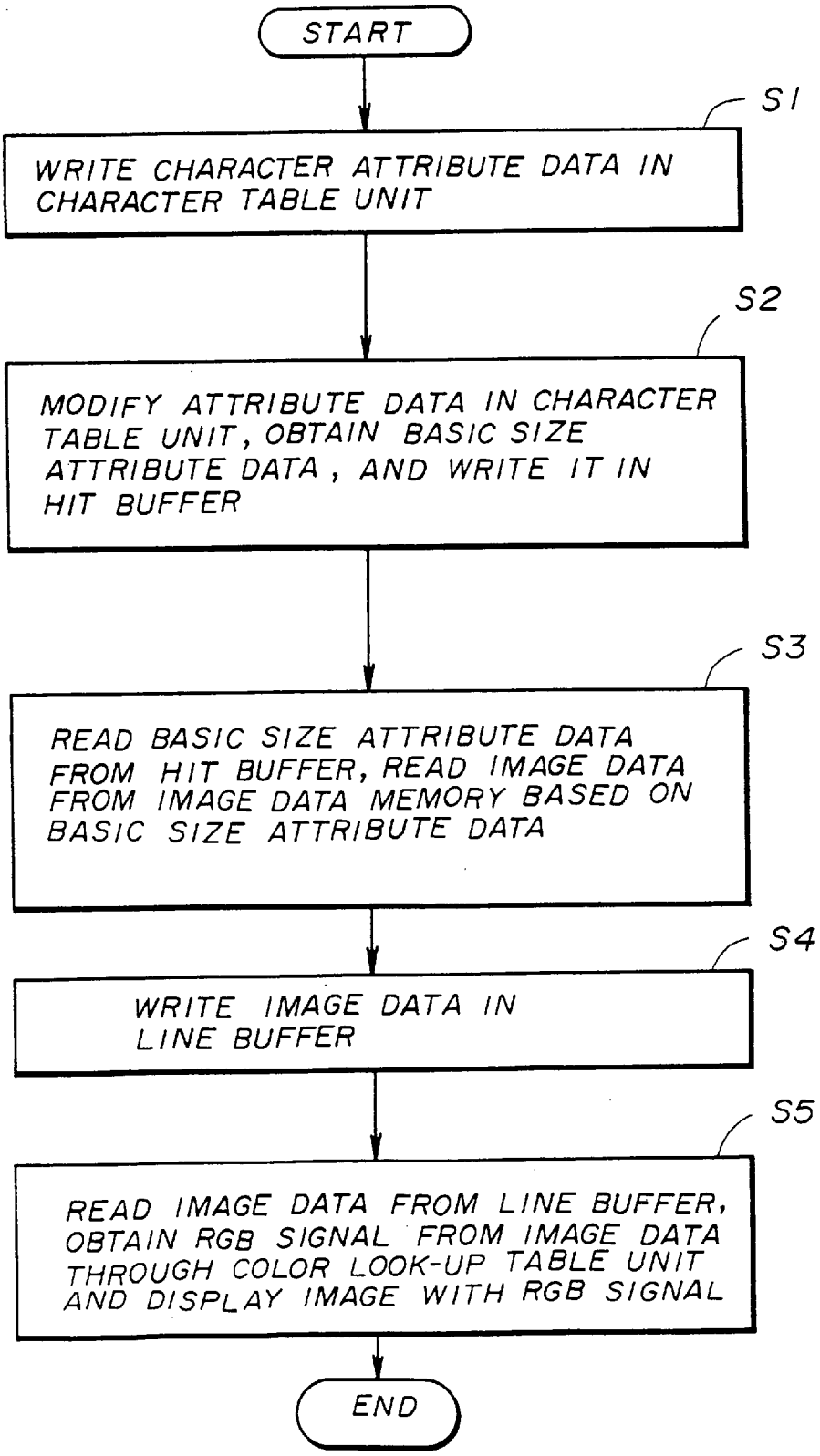
FIG. 14 shows a general basic operation flow of operations performed by the embodiment and variant example thereof of the present invention.

Further, functions similar to those of the above-described embodiment of the present invention shown in FIG. 1 can also be performed, as a variant example of that the embodiment, through a general-purpose computer, such as a personal computer shown in FIG. 13, that includes appropriate information storage devices such as a hard disk drive device, a floppy disk drive device, a ROM, a RAM and/or the like, and is specially configured by predetermined software stored in a computer-usable medium such as a floppy disk shown in FIG. 13. FIG. 14 shows a general basic operation flow of the embodiment of the present invention. In a step S1 (hereinafter, the term 'step' being omitted), character attribute data is written in the character table unit 4. In S2, the character attribute data is appropriately modified, basic size attribute data of basic size character rectangles is produced and written in the hit buffer 6. The basic size attribute data is read from the hit buffer 6, and based thereon, image data is read from the image data memory 8, in S3, and is written in the line buffer 9, in S4. In S5, the image data is read from the line buffer 9, an RGB signal is obtained from the image data through the color look-up table unit 10, and a color image is displayed on the scanning-type display in accordance with the RGB signal.

Further, the present invention is not limited to the above-described embodiments, and variations and modifications may be made without departing from the scope of the present invention.

What is claimed is:

1. An image display control device, comprising;

a first storage device for storing, as attribute data of each character, at least a character name, a horizontal direction character size, a vertical direction character size, a horizontal display coordinate value, and a vertical display coordinate value;

a counter for outputting count values indicating a horizontal position and a vertical position in a display screen image;

a first writing control means for reading from the first storage device the attribute data of an appropriate character based on the count values of said counter and the attribute data, producing basic size attribute data of basic size characters which constitute at least part of said character, said basic size characters being determined to be currently displayed based on said count values, and writing said basic size character attribute data in a second storage device;

a third storage device for storing character image data;

a second writing control means for reading basic size attribute data from said second storage device, producing addresses based on said basic size attribute data to read character image data from said third storage device, and writing said character image data into a fourth storage device; and means for reading image data, stored in said fourth storage device, in synchronization with said count value indicating a current horizontal position.

2. The image display control device according to claim 1, wherein:

the horizontal size of said character is set to be a natural number multiple of the horizontal size of a basic size character by said horizontal direction character size;

the vertical size of said character is set to be a natural number multiple of the vertical size of a basic size character by said vertical direction character size; and said basic size character has a size defined by a predetermined number of dots in the horizontal direction by a predetermined number of dots in the vertical direction.

3. The image display control device according to claim 1, wherein bits allocated for said horizontal display coordinate and said vertical display coordinate are set such that said bits may include bits which are located outside of the horizontal and vertical direction coordinate range of said display screen image.

4. The image display control device according to claim 1, wherein:

said first writing control means reads attribute data of each character from said first storage device and writes in said second storage device the basic size attribute data of basic size characters during a display period in a horizontal scanning period, said basic size characters constituting a part of a character which is determined to be displayed in the subsequent horizontal scanning period;

said second writing control means successively reads basic size attribute data from said second storage device in a horizontal retrace period, reads image data by providing addresses based on said basic size attribute data to said third storage device, and writes said image data in said fourth storage device.

5. The image display control device according to claim 1, wherein said first writing control means comprises:

determining means for determining whether a character read from said first storage device is a relevant character, based on a count value of said counter indicating a current vertical position, and said vertical display coordinate and said vertical direction character size of said attribute data, said determining means providing a determination result;

writing control signal generating means for generating at least one writing control signal to said second storage device based on said determination result and said horizontal direction character size in said attribute data;

a first modifying unit for generating first writing data based on a count value indicating a current vertical position, and said vertical display coordinate, character name, horizontal direction character size and vertical direction character size of said attribute data;

a second modifying unit for generating second writing data based on a count value indicating a current vertical position, said vertical direction character size and vertical display coordinate of said attribute data; and a third modifying unit for generating third writing data based on said horizontal direction character size and horizontal display coordinate of said attribute data.

6. The image display control device according to claim 1, wherein said second storage device comprises:

a memory unit for storing basic size attribute data; and an address generating circuit for generating addresses in one of an increasing order and a decreasing order when said first writing control means writes data in said memory unit, and generating addresses in the other of said increasing order and decreasing order when said second writing control means reads data from said memory unit.

7. The image display control device according to claim 6, wherein:

said second storage device is provided with a first flag which is set when said address generating circuit generates a first predetermined address and a second flag which is set when said address generating circuit generates a second predetermined address;

said first writing control means is provided with a writing request generating means for preventing data from being written in said second storage device when said first flag is set, said writing request generating means requesting data writing when said first flag is not set; and said second writing control means is provided with a reading request generating means for preventing data from being read from said second storage device when said second flag is set and, said reading request generating means requesting data reading when said second flag is not set.

8. The image display control device according to claim 7, wherein said first writing control means is provided with a third flag which is set when data is attempted to be written in said storage means in a condition where said first flag is set.

9. The image display control device according to claim 8, wherein contents of attribute data stored in said first storage device can be altered by instructions given by a central processing unit, and said central processing unit recognizes the set state of said third flag as an interrupt signal.

10. The image display control device according to claim 1, wherein:

a display selection flag being set as one of the attribute data stored in said first storage device;

a plurality of said fourth storage devices are provided; and said second writing control means selectively writes data in one of said plurality of said fourth storage devices based on said display selection flag.

11. The image display control device according to claim 1, further comprising:

a boundary register for storing an address value indicating a boundary for dividing said first storage device into two portions; and at least two of said fourth storage devices;

wherein said second writing control means selectively writes data in one of said at least two of said fourth storage devices based on said address value.

12. The image display control device according to claim 1, wherein:

a color selection flag is set as one of the attribute data stored in said first storage device; and said second writing control means adds data, specified by said color selection flag, to image data and writes resulting image data in said fourth storage device.

13. The image display control device according to claim 1, wherein:

an inversion flag is set as one of the attribute data stored in said first storage device; and said first writing control means produces basic size attribute data depending on said inversion flag; and said second writing control means produces image data to be provided to said fourth storage device depending on said inversion flag.

14. The image display control device according to claim 1, further comprising an offset register for indicating an offset position in a screen image, said first writing control means produces basic size attribute data depending on said offset resister value.

15. A computer-implemented image display control method, comprising the steps of:

producing character attribute data for accessing an image data memory to obtain a desired character image in an attribute size;

dividing the desired character image into predetermined basic size portions;

producing a basic size character attribute data for each predetermined basic size portion of said character image for each scanning line, based on said character attribute data, accessing said image data memory in accordance with each said basic size character attribute data for obtaining said basic size portion of said character image for each scanning line; and displaying each said basic size portion of said character image for each scanning line.

16. A computer program product for image display control, comprising:

a computer usable medium having computer readable program code means embodied in said medium, said computer readable program code means comprising:

program code means for producing character attribute data for accessing an image data memory to obtain a desired character image in an attribute size;

program code means for dividing the desired character image into predetermined basic size portions;

program code means for producing a basic size character attribute data for each predetermined basic size portion of said character image for each scanning line, based on said character attribute data;

program code means for accessing said image data memory in accordance with each said basic size attribute data for obtaining said basic size portion of said character image for each scanning line; and program code means for displaying each said basic size portion of said character image for each scanning line.

* * * * *